US007547230B1

(12) United States Patent
Strausser et al.

(10) Patent No.: US 7,547,230 B1
(45) Date of Patent: Jun. 16, 2009

(54) SPRING CLIP FOR CONNECTOR HOUSING

(75) Inventors: David Charles Strausser, Winston-Salem, NC (US); David Allen Klein, Kernersville, NC (US); Matthew Chris Peterson, Albert Lea, MN (US); Jaroslaw Henryk Dawidziuk, Whitby (CA)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/201,274

(22) Filed: Aug. 29, 2008

(51) Int. Cl.
*H01R 13/73* (2006.01)

(52) U.S. Cl. ..... 439/545

(58) Field of Classification Search ..... 439/545
See application file for complete search history.

(56) References Cited

U.S. PATENT DOCUMENTS 4,647,129 A * 3/1987 Kandybowski et al. ..... 439/246
6,171,141 B1 * 1/2001 Yasui et al. ..... 439/545
6,332,806 B1 * 12/2001 Yasui et al. ..... 439/545

* cited by examiner

*Primary Examiner*—Gary F. Paumen

(57) ABSTRACT

An electrical connector assembly is shown which is profiled for mounting to a wall. The assembly is comprised of an insulative housing having an outer profile, at least one abutment portion, such as a flange, having an abutting surface outside of the outer profile, and a retaining surface spaced from the abutting surface. A retaining member is operably engageable with the retaining surface, and the retaining member has an orientation member preventing incorrect orientations between the retaining member and the housing.

20 Claims, 11 Drawing Sheets

SPRING CLIP FOR CONNECTOR HOUSING

FIELD OF INVENTION

This application is directed to an electrical connector of the type where the connector is held to a device by way of a retaining member.

BACKGROUND OF THE INVENTION

Many applications exist where electrical connectors are positioned against a device, such as an engine or a bulkhead wall. The connector is positioned within an aperture of the device and held to the device by way of a spring clip. The spring clip generally has a U-shaped configuration having legs that flank the connector and is curved such that it is spring loaded between the connector and the device to hold the connector in place. Due to the location of the connector relative to other components on the device, it is sometimes necessary to insure that the connector when clipped to the device has a specific orientation. The connectors and their associated spring clips heretofore have no mechanism for assuring that the connector is in a specific orientation and it may be very costly to determine that the connector is not in the proper orientation when that fact is finally determined. It may also be desirable due to the environment in which the clipped connector is mounted, to have an enhanced retention between the connector and the device.

SUMMARY OF THE INVENTION

In one embodiment, an electrical connector assembly is profiled for mounting to a wall. The assembly comprises a connector housing having an outer profile, at least one abutment portion having an abutting surface outside of said outer profile, and a retaining surface spaced from the abutting surface. A retaining member is operably engageable with the retaining surface, and the retaining member has an orientation member preventing incorrect orientations between the retaining member and the housing.

In another embodiment, an electrical connector assembly is profiled for mounting to a wall, and comprises an insulative housing having an outer profile, at least one abutment portion having an abutting surface outside of the outer profile, and a retaining surface spaced from the abutting surface. A retaining member is operably engageable with the retaining surface, the retaining member having a latching member latchably connecting the retaining member to the housing.

DETAILED DESCRIPTION OF EMBODIMENTS

Figure 1:
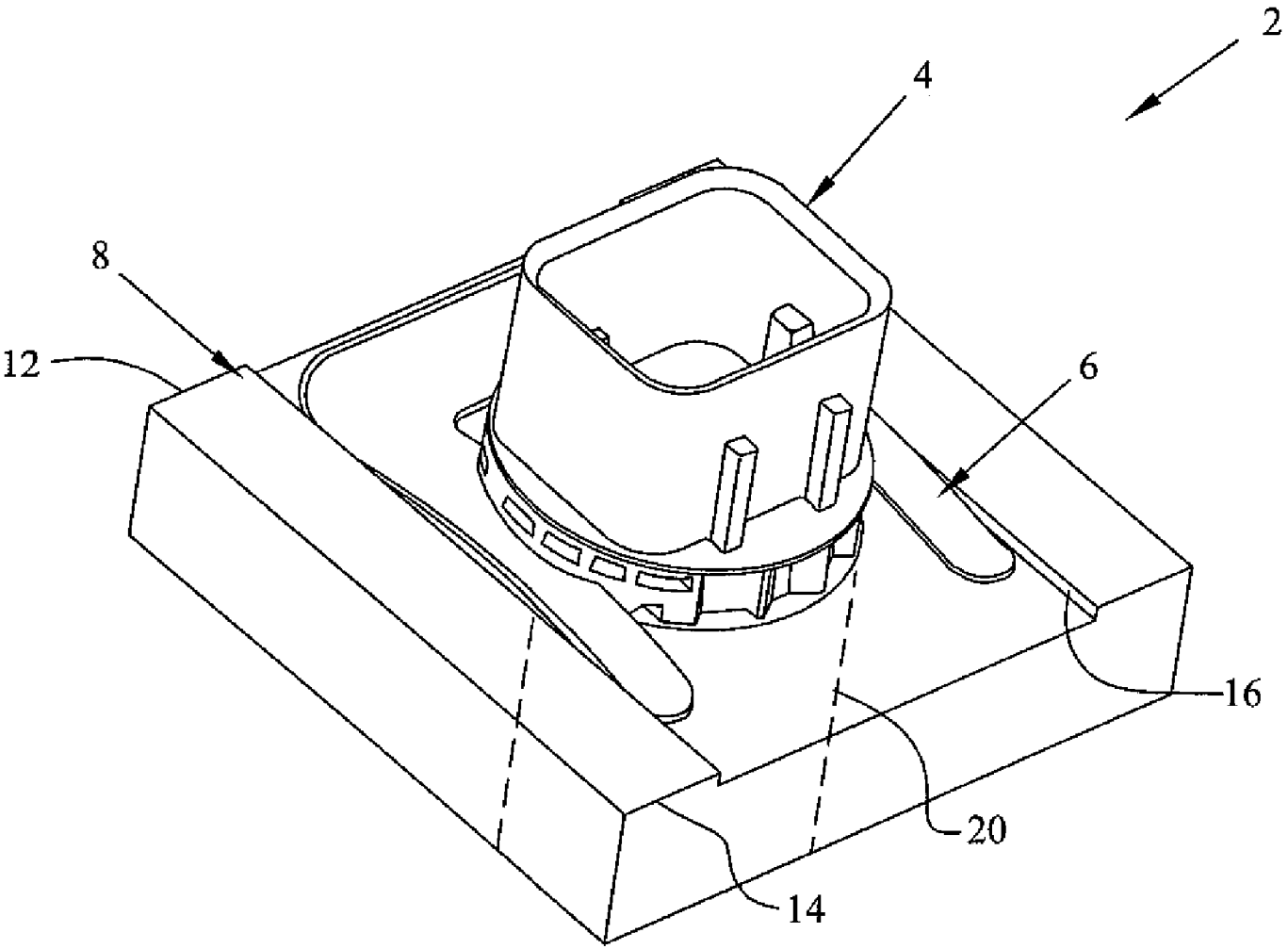
FIG. 1 shows a first embodiment of a connector assembly mounted to a device wall including a first embodiment of a retaining member.

With reference first to FIG. 1, an electrical connector assembly is shown at 2 which is generally comprised of an insulative connector housing 4 having an outer profile, and a retaining member 6 in the form of a spring clip. As shown, the connector housing 4 is attached to a wall or device 8 which, for example, could be a bulkhead wall or could be a wall of a device such as an engine. For the purposes herein, reference to item 8 will be generally to a wall, with the understanding that any structure could be substituted for the wall 8. It should be also understood that wall 8 includes a top portion 12 and a bottom portion 14 however applicants refer to these features only from an orientation standpoint and not in a limiting manner.

However, it is desirable for connector housing 4 to be attached to wall 8 in a specific orientation, such that retaining member 6 is inserted from a top side of the wall and moved downwardly within a channel 16. It should also be understood that retaining member 6 assists in the orientation of the connector to ensure that its orientation is proper relative to the general orientation of wall 8, as more fully described herein. However, it should also be understood that it may, in certain circumstances, be desirable to orient the housing 4 with the retaining member 6 receivable T from the bottom portion 14 towards the top portion 12, or from side-to-side. Finally it should also be understood that connector housing 4 is insertable from a backside of wall 8 through an aperture 20 (shown in phantom FIG. 1), whereby retaining member 6 holds connector housing 4 in its orientation.

Figures 2, 3:
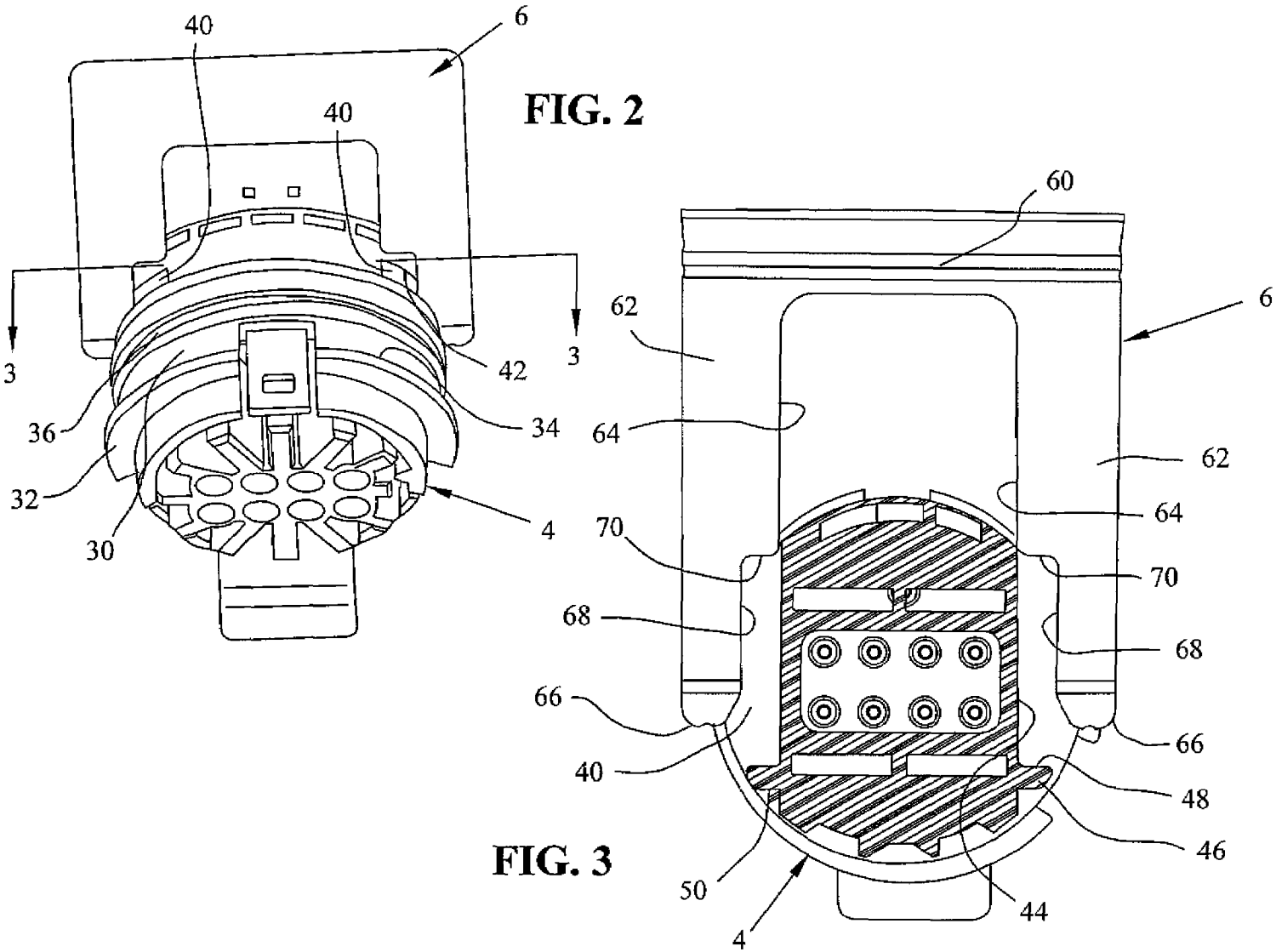
FIG. 2 shows a lower perspective view of the connector assembly of FIG. 1 removed from the wall.
FIG. 3 is a cross-sectional view through lines 3-3 of FIG. 2.

With reference now to FIG. 2, the configuration of the connector housing 4 will be described in greater detail. Connector housing 4 is shown with a partially cylindrical configuration including a cylindrical body portion 30 having an abutment portion 32 in the form of a flange, which is generally outside of the outer profile of cylindrical body portion 30. Flange 32 includes an internally abutting surface shown generally at 34. A seal 36 is positioned within a peripheral groove of cylindrical portion 30 to sealingly locate the cylindrical portion 30 within opening 20 (FIG. 1). Connector housing 4 further includes two slots 40 where each slot 40 defines a retaining surface 42 to cooperate with the retaining member 6 as described herein. With respect now to FIG. 3, the configuration of the slot 40 will be described in greater detail. As shown in FIG. 3, which is a cross-sectional view taken through the slot 40, slot 40 defines inner edges 44 having stop members 46 which define stop edges 48 and 50 as further described herein.

With reference to FIG. 3, retaining member 6 is shown in greater detail. Retaining member 6 is generally U-shaped in configuration and includes a bight portion 60, integral spring clip arms 62 having inner edges 64, free ends 66 and notched portions 68 defining an orientation member in the form of stop surfaces 70.

With reference still to FIG. 3, connector housing 4 is shown in its proper orientation with retaining member 6 partially inserted in slot 40. As shown, inner edges 64 of arms 62 will cooperate with inner edges 44 of the slot 40 until stop surfaces 70 of notched portions 68 contact stop edges 48 of stop members 46. This will trap the connector in wall 8 in the proper orientation within channel 16 (FIG. 1), trapped between retaining member 6 and flange 32.

Figure 4:
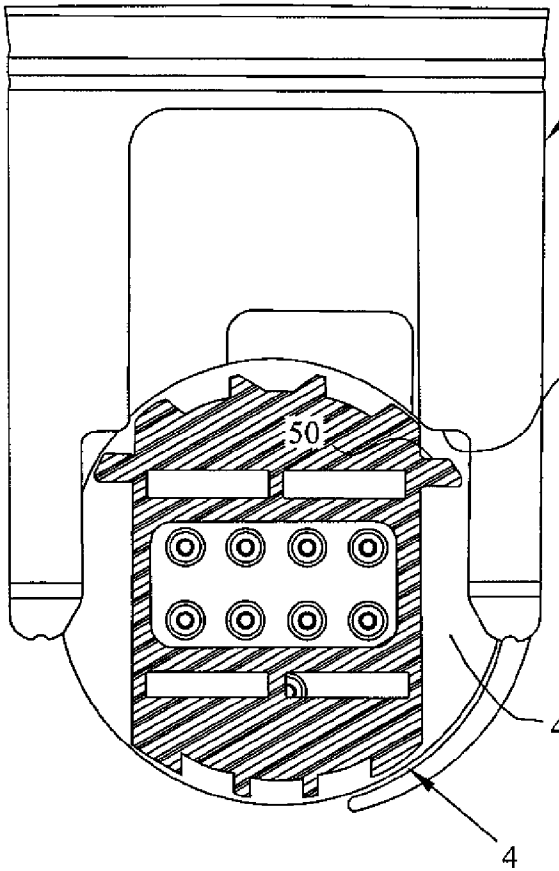
FIG. 4 is a cross-sectional view similar to that of FIG. 3 showing an improper orientation of the connector housing/retaining member.

If the connector housing 4 is improperly oriented, as shown in FIG. 4, retaining member 6 cannot be fully positioned in slot 40. Stop surfaces 70 will abut stop edges 50 indicating improper orientation of connector housing 4. It should be appreciated that the wall 8 would include some naturally existing deterrent provided thereon, which would prevent the retaining member 6 from insertion from the bottom to top (as viewed in FIG. 4).

Figure 5:
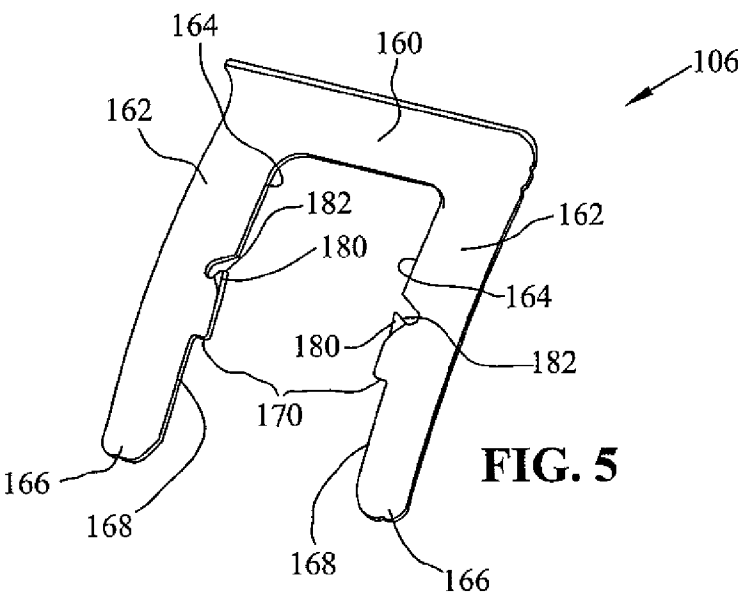
FIG. 5 shows a second embodiment of a retaining member.

With respect now to FIG. 5, an alternate retaining member is shown as spring clip 106 having a bight portion 160, spring clip arms 162 having inner edges 164, free ends 166, and notched portions 168 defining an orientation member in the form of stop surfaces 170. In addition, a retention member or latch is shown at 180 which is turned up to define a stop edge 182.

Figure 6:
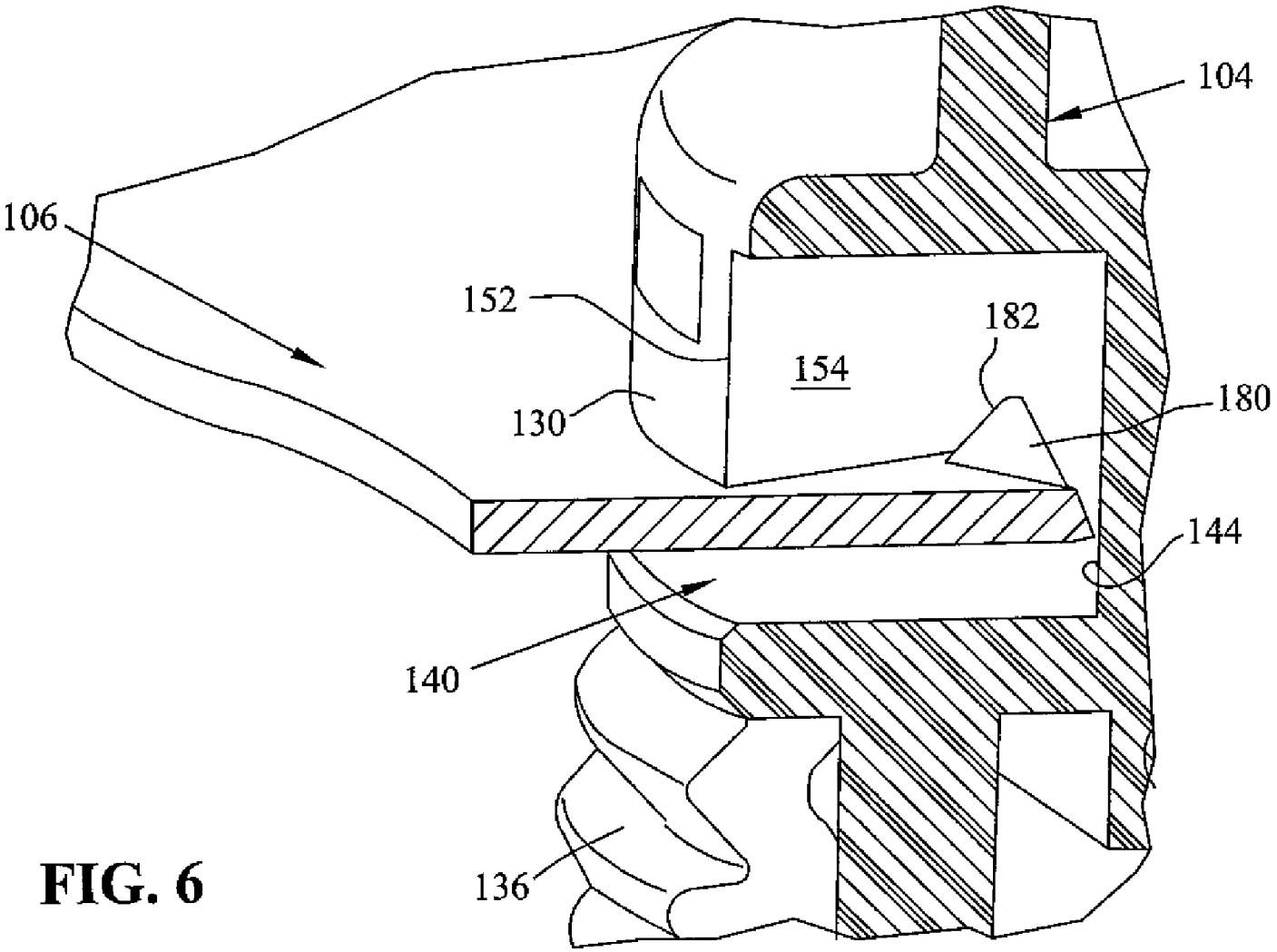
FIG. 6 shows a fragmentary view showing the retaining member of FIG. 5 in the housing slot.

With reference now to FIG. 6, a connector housing is shown at 104, which is similar to connector housing 4, and 104 includes a cylindrical body portion 130, a seal 136, a slot 140 having inner edges 144. Connector housing 104 differs in that it includes an opening 152 molded transversely of slot 140 to define a retaining surface 154. In this embodiment, retaining member 106 would be slideably receivable into slot 140 until such time as latch 180 clears surface 154. At this point, stop edge 182 abuts retaining surface 154, and retains the retaining member 106 in place. Stop surfaces 170 would operate in a similar manner as the embodiment described with reference to FIGS. 1-4, in both correct and incorrect orientations. It should be appreciated that due to the configuration of the retaining clip, that is the arc-shaped structure, that the retaining clip would be normally biased upwardly into the configuration shown in FIG. 6.

Figure 7:
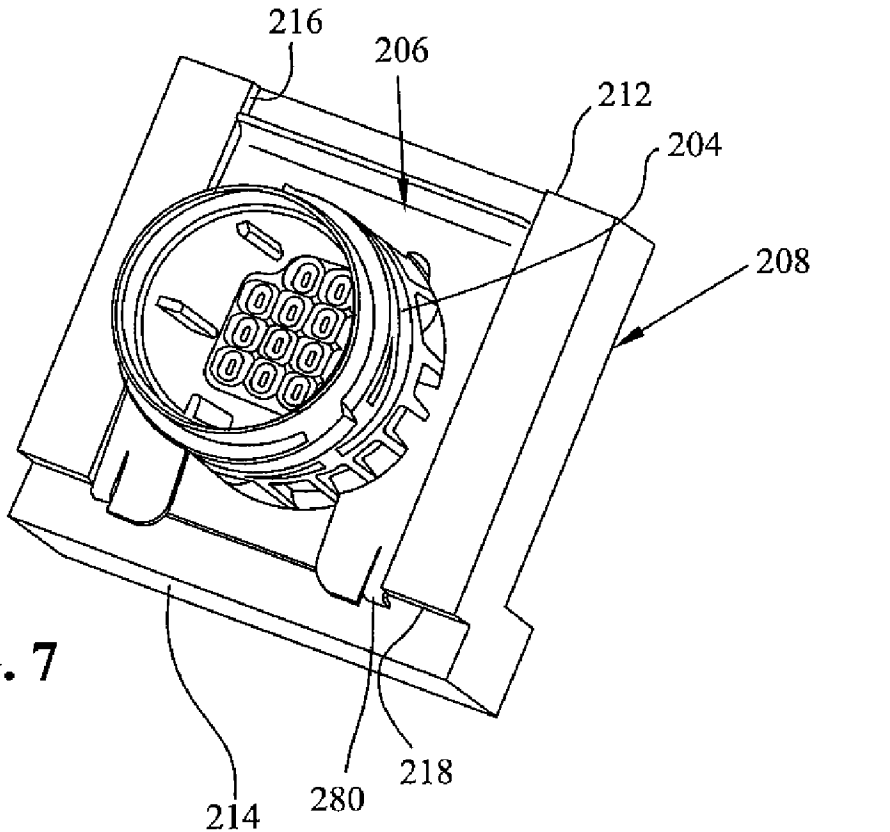
FIG. 7 shows a top perspective view of another embodiment of connector assembly connected to a wall, including a third embodiment of retaining member.
Figure 8:
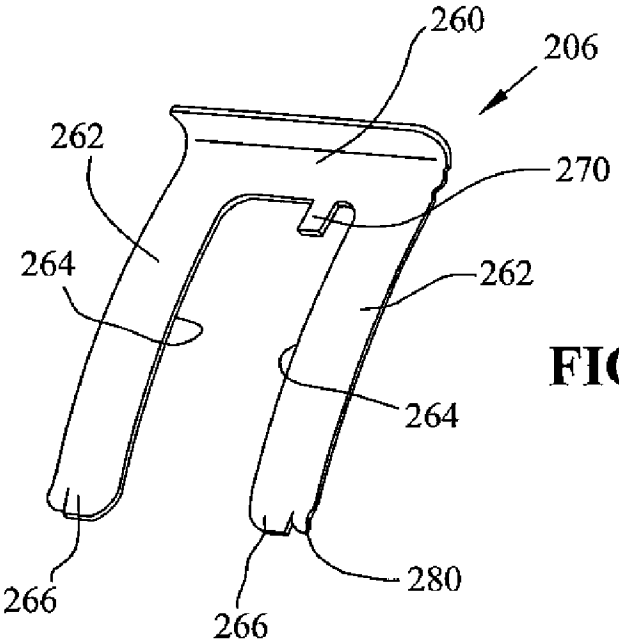
FIG. 8 shows a top perspective view of the retaining member of FIG. 7.

With reference now to FIG. 7, another embodiment of an electrical connector assembly is shown at 202 having a connector housing 204, and a retaining member 206 where the retaining member 206 retains housing 204 to a wall 208. Wall 208 would also include a top portion 212, a bottom portion 214 and a channel 216 to receive the retaining member 206 as well as a front edge 218 to assist in latching retaining member 206 to the wall 208 as further described herein. With reference now to FIG. 8, an alternate retaining member is shown as retaining member 206 having a bight portion 260, spring clip arms 262 having inner edges 264, free ends 266, orientation member 270 and having latch members 280.

Figure 9:
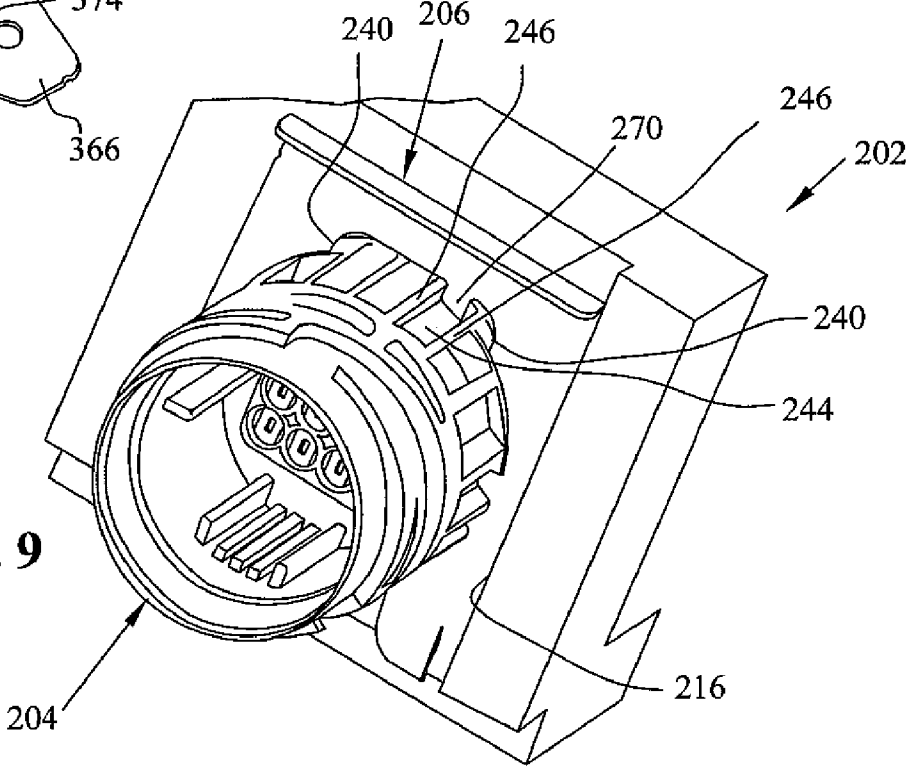
FIG. 9 shows a top perspective view of the embodiment of FIG. 7.
Figure 10:
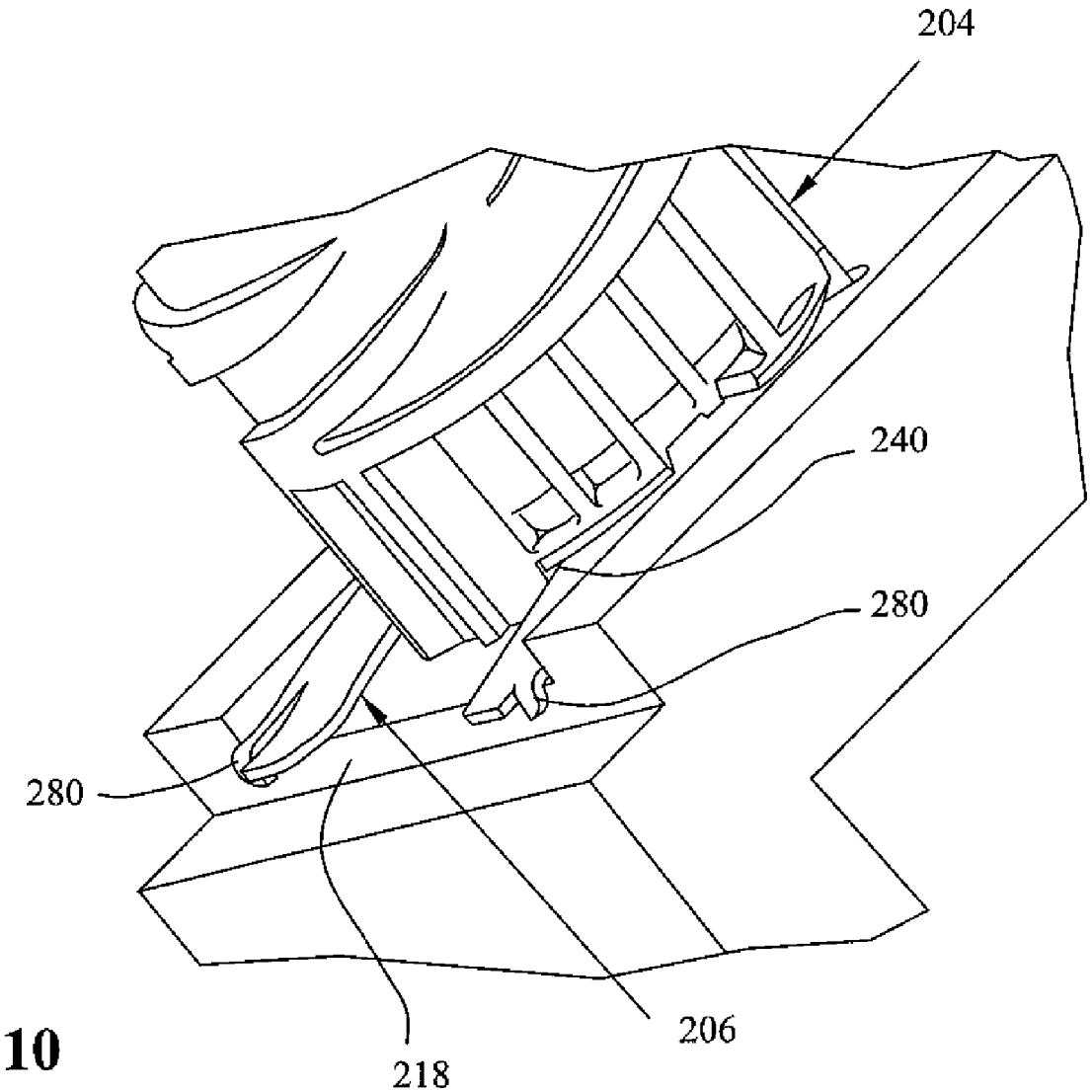
FIG. 10 shows a top fragmentary view of the embodiment of FIG. 7 showing the latching of the retaining member.

With respect now to FIGS. 9 & 10, connector housing 204 includes slots 240 which simply pass straight through housing 204 (without the need for a stop member such as 48 (FIG. 3)). Housing 204 also includes a molded passage at 244 defining stop edges 246 which receive orientation member 270 of retaining member 206. With respect to FIG. 10, retaining member 206 is shown positioned in slots 240 and with latches 280 snapped over front edge 218. In the event that housing 204 were wrongly positioned, that is 180 degrees from the position shown in FIG. 10, orientation member 270 (FIG. 9) would abut the connector housing 204 preventing the retaining member 206 from achieving its fully latched position with latch members 280 extending over front edge 218.

Figure 11:
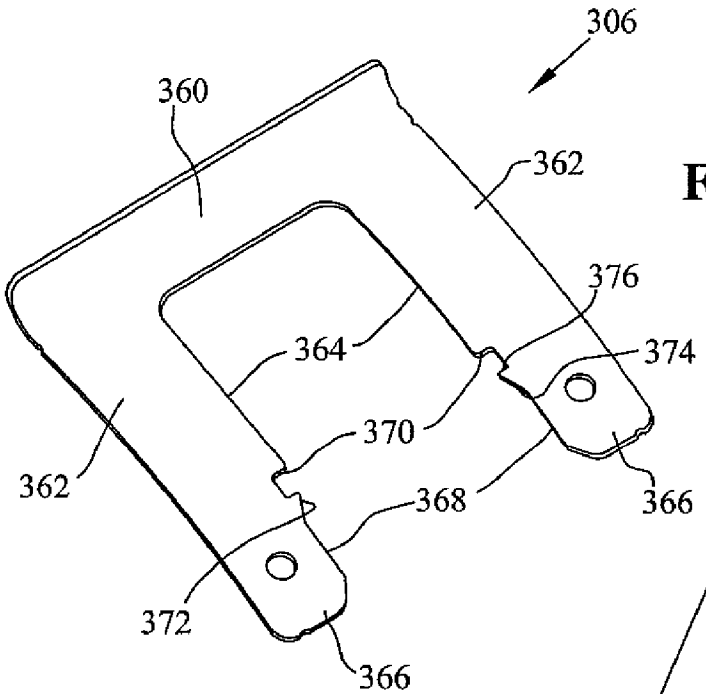
FIG. 11 shows a fourth embodiment of retaining member.

With respect now to FIG. 11, a further alternate retaining member is shown as spring clip 306 having a bight portion 360, spring clip arms 362, having inner edges 364, free ends 366, notched portions 368 which define orientation members in the form of stop surfaces 370 and locking lances 372 defining ramp surfaces 374 and locking edges 376.

Figure 12:
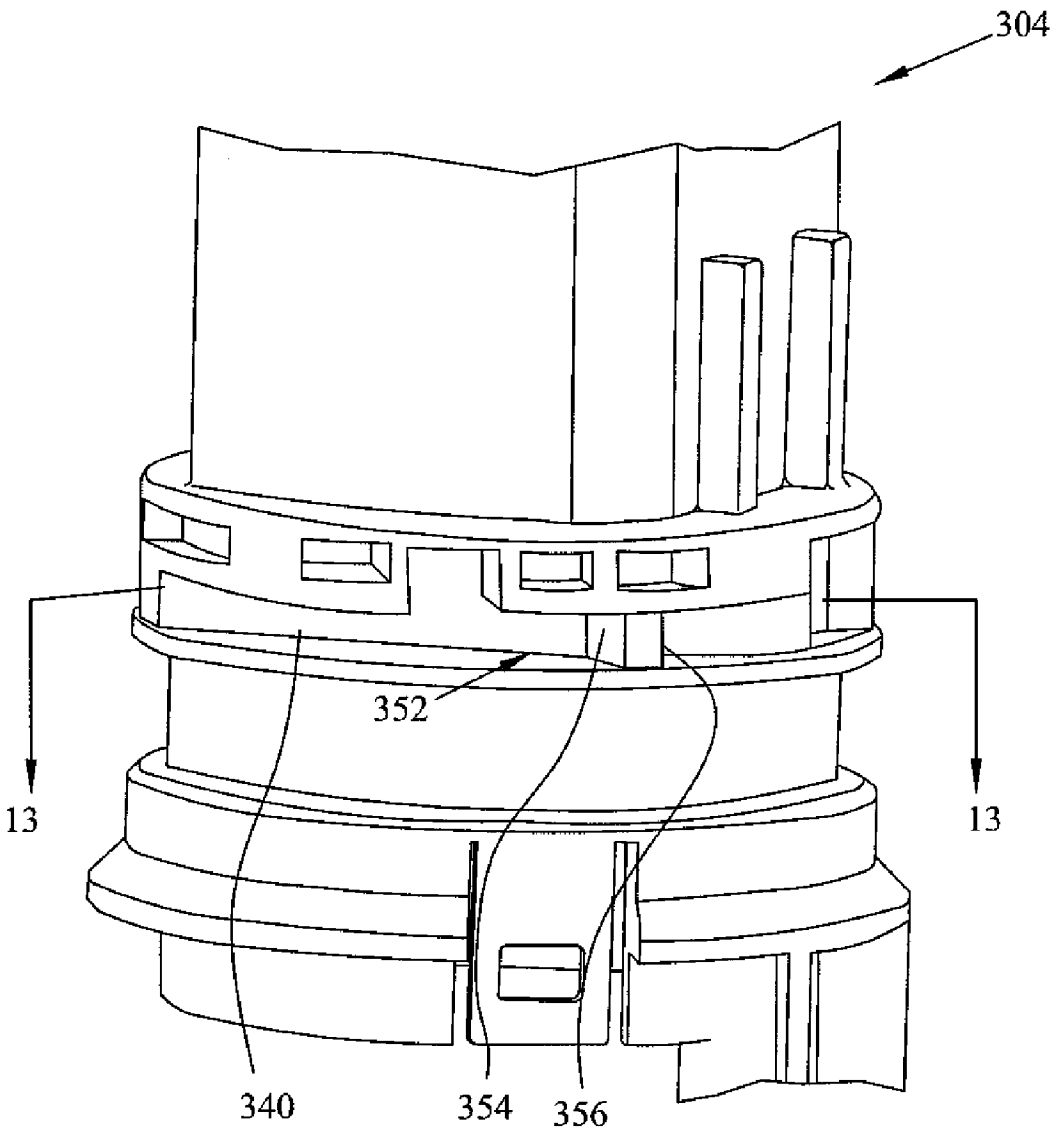
FIG. 12 shows a fragmentary view of the connector housing which may be used with the retaining member of FIG. 11.
Figure 13:
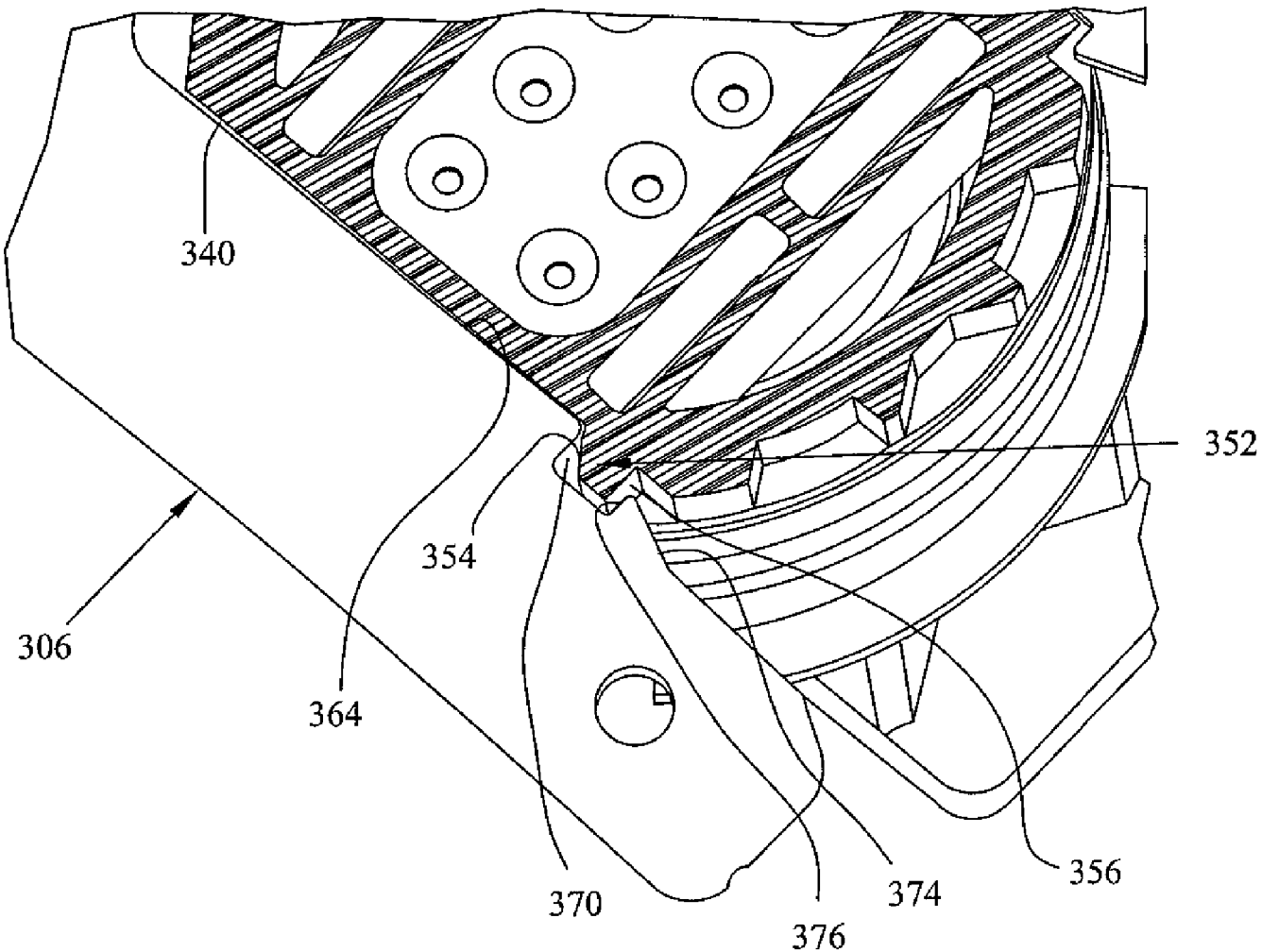
FIG. 13 shows the cross-sectional view through lines 13-13 of FIG. 12 with the retaining member of FIG. 11 in place.

As shown in FIG. 12, connector housing 304 includes slots 340 on each side thereof for receiving a retaining member 306, in order to retain connector housing 304 within a wall similar to that of walls 8, 208. Connector housing 304 further includes a latch member 352 integrally molded within the slot. With reference to both FIGS. 12 and 13, latch member 352 is comprised of a ramp surface 354 and a latching edge 356. As shown in FIG. 13, retaining member 306 is shown in the fully inserted position. It should be appreciated that during the insertion of the retaining member 306, corresponding surfaces 354, 374 allow the retaining member to pass the latch member 352 to a position where surfaces 356 and 376 are locked against each other, and that latch member 352 is positioned in the void defined between surfaces 370 and 376 as shown in FIG. 13. As in previous embodiments, if the retaining member were inserted from the opposite side (or if connector housing 340 were diametrically opposite), edges 370 would abut rear latching surface 356 preventing the retaining member 306 from entry into slots 340.

Figure 14:
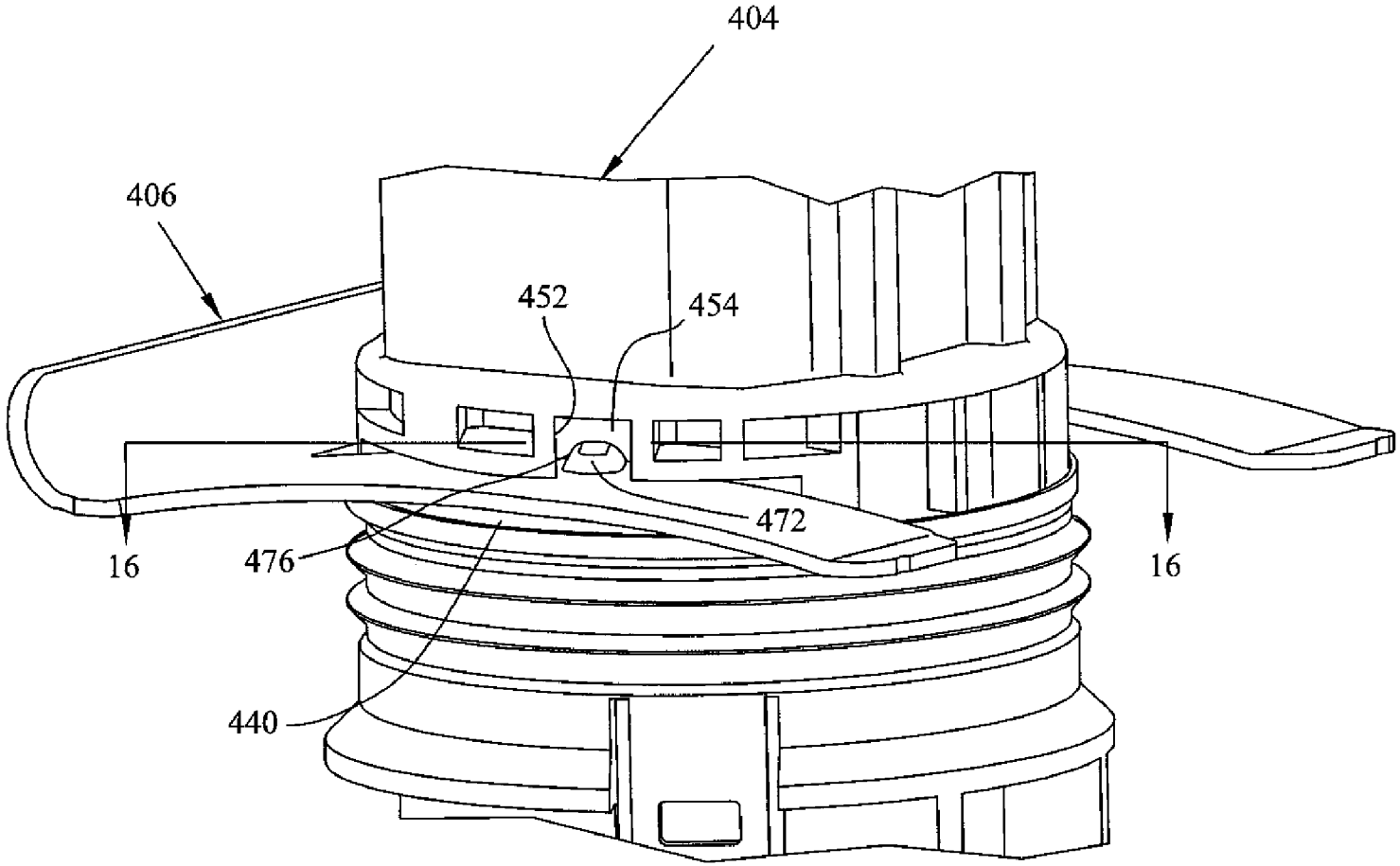
FIG. 14 shows a fragmentary view of a further embodiment of connector housing.
Figure 16:
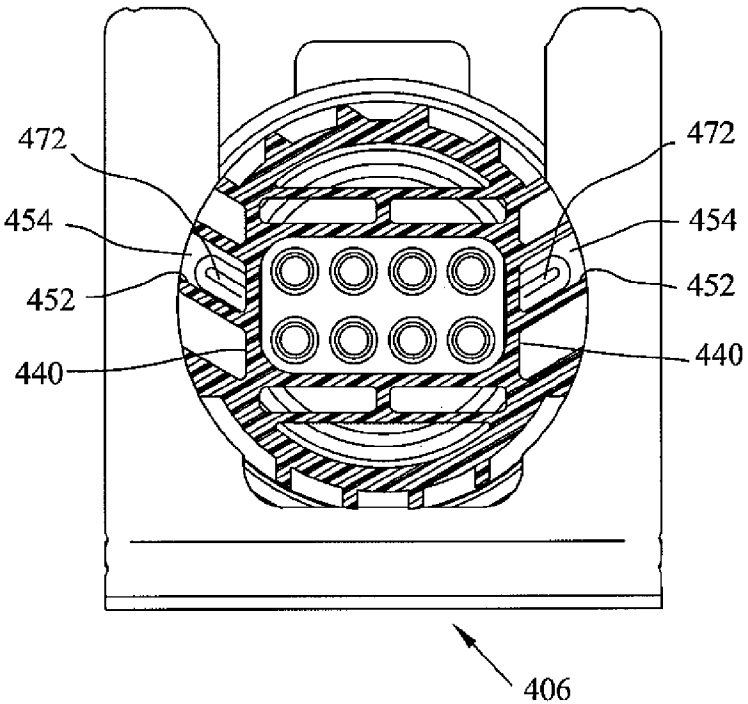
FIG. 16 shows the cross-sectional view through lines 16-16 of FIG. 14 with the retaining member of FIG. 15 in place.
Figure 15:
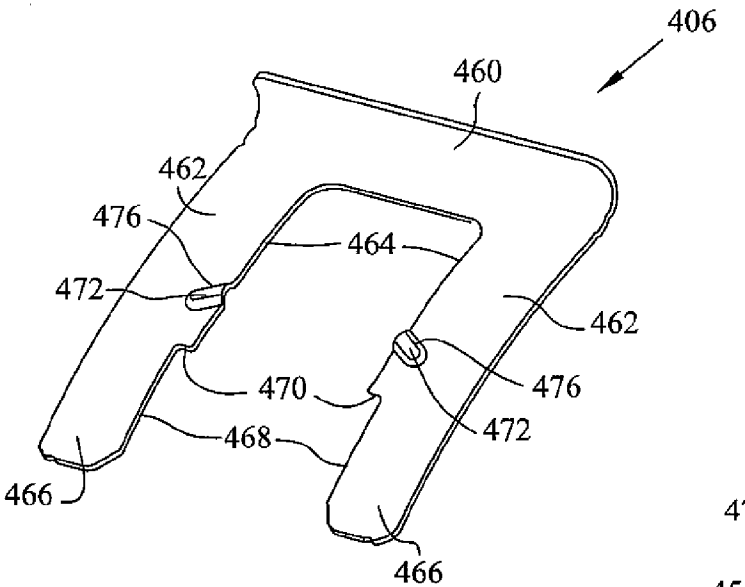
FIG. 15 shows a fifth embodiment of retaining member for use with the housing of FIG. 14.

Finally, and with respect to FIGS. 14-16, a further alternate assembly is shown as housing 404 and spring clip 406. As shown best in FIG. 15, spring clip 406 has a bight portion 460, spring clip arms 462 having inner edges 464, free ends 466, notched portions 468 which define orientation members in the form of stop surfaces 470 and locking projections 472 defining locking edges 476.

Connector housing 404 includes slots 440 on each side thereof for receiving a retaining member 406, in order to retain connector housing 404 within a wall similar to that of walls 8, 208. Connector housing 404 further includes a latch member 452, in the form of an edge of molded opening 454, integrally molded within the housing 404. As shown in FIGS. 14 and 16, retaining member 406 is shown in the fully inserted position. It should be appreciated that during the insertion of the retaining member 406, the retaining member passes through the slots 440 to a position where locking edges 476 are locked against latch member 452. As in previous embodiments, if the retaining member were inserted from the opposite side (or if connector housing 440 were diametrically opposite), edges 470 would abut rear latching surfaces (not shown, but similar to edges 50, FIG. 3) preventing the retaining member 406 from entry into slots 440.

What is claimed is:

1. An electrical connector assembly for mounting to a wall, the assembly comprising a connector housing having an outer profile, at least one abutment portion having an abutting surface outside of said outer profile, and at least one retaining surface spaced from said abutting surface, and a retaining member operably engageable with the retaining surface, the retaining member having an orientation member allowing only one orientation between said retaining member and said housing.

2. The electrical connector assembly of claim 1, wherein said abutment portion is a flange.

3. The electrical connector assembly of claim 1, wherein said retaining surface is defined by a slot in said housing.

4. The electrical connector of claim 1, wherein said retaining member is defined by a generally U-shaped clip, and two retaining surfaces are provided by slots on each side of the housing.

5. The electrical connector of claim 4, wherein the generally U-shaped clip is comprised of spring clip arms extending from a bight portion.

6. The electrical connector of claim 5, wherein the orientation member is positioned on the spring clip arms.

7. The electrical connector of claim 6, wherein the orientation member is defined by notched portions in the clip arms, and stop member in the housing.

8. The electrical connector of claim 5, wherein the orientation member is positioned on the bight portion, and the housing is profiled to receive the orientation member.

9. The electrical connector of claim 1, further comprising a latching member latchably connecting the retaining member to said housing.

10. The electrical connector of claim 6, further comprising a latching member latchably connecting the retaining member to said housing.

11. An electrical connector assembly for mounting to a wall, the assembly comprising an insulative housing having an outer profile, at least one abutment portion having an abutting surface outside of said outer profile, and at least one retaining surface spaced from said abutting surface, said retaining surface having an outer profile radially within the outer profile of said abutting surface, and a retaining member operably engageable with the retaining surface, the retaining member having a latching member latchably connecting the retaining member to said housing.

12. The electrical connector of claim 11, wherein said abutment portion is a flange.

13. The electrical connector of claim 11, wherein said retaining surface is defined by a slot in said housing.

14. The electrical connector of claim 11, wherein said retaining member is defined by a generally U-shaped clip, and two retaining surfaces are provided by slots on each side of the housing.

15. The electrical connector of claim 14, wherein the generally U-shaped clip is comprised of clip arms extending from a bight portion.

16. The electrical connector of claim 14, wherein the retaining member is positioned on the clip arms.

17. The electrical connector of claim 16, wherein the retaining member is positioned on the free ends of the clip arms.

18. The electrical connector of claim 16, wherein the retaining member is positioned on the inside edges of the clip arms.

19. The electrical connector of claim 11, further comprising an orientation member preventing incorrect orientations between said retaining member and said housing, wherein the orientation member is positioned on the clip arms.

20. The electrical connector of claim 19, further comprising an orientation member preventing incorrect orientations between said retaining member and said housing, wherein the orientation member is defined by recessed notches in the clip arms, and stop members in the housing.

* * * * *